US005501246A

United States Patent [19]

Burns et al.

[11] Patent Number: 5,501,246

[45] Date of Patent: Mar. 26, 1996

[54] AIR/VAPOUR SEPARATION DEVICE

[75] Inventors: David R. Burns; Victor C. Turner, both of Sydney, Australia

[73] Assignee: Gilbarco Limited, Basildon, United Kingdom

[21] Appl. No.: 137,046

[22] PCT Filed: Apr. 23, 1992

[86] PCT No.: PCT/GB92/00750

§ 371 Date: Oct. 19, 1993

§ 102(e) Date: Oct. 19, 1993

[87] PCT Pub. No.: WO92/19531

PCT Pub. Date: Nov. 12, 1992

[30] Foreign Application Priority Data

Apr. 26, 1991 [AU] Australia ..... PK5838

[51] Int. Cl.[6] ..... B67D 5/58

[52] U.S. Cl. ..... 137/179; 137/177; 96/204

[58] Field of Search ..... 137/197, 199, 137/173, 175, 179, 177, 176, 180; 96/204, 220

[56] References Cited

U.S. PATENT DOCUMENTS 2,680,538 6/1954 Fishburn ..... 137/179 X 2,960,104 11/1960 Hudson ..... 137/202

3,867,955 2/1975 Scott et al. ..... 137/179

4,978,374 12/1980 Janssen et al. ..... 55/165

*Primary Examiner*—Martin P. Schwadron

*Assistant Examiner*—Kevin L. Lee

*Attorney, Agent, or Firm*—Spencer & Frank

[57] ABSTRACT

A device for separating gas entrained in a flow of liquid. The device comprises a main housing having a liquid inlet and a liquid outlet. A separation chamber is disposed within the housing between the inlet and the outlet, the gas entrained in the flow of liquid being separated from the flow of liquid when the flow of liquid passes from the inlet to the outlet within the separation chamber. A vent passage extends from the separation chamber. A main valve within the housing controls the flow of liquid between the inlet and the outlet. A detector including a dual orifice arrangement disposed in the vent passage detects the presence of a gas in the vent passage. A pilot valve is coupled to the detector and to the main valve for controlling the main valve as a function of the presence of gas in the vent passage. A first control passage is disposed within the housing for coupling the pilot valve to the dual orifice arrangement.

10 Claims, 5 Drawing Sheets

AIR/VAPOUR SEPARATION DEVICE

FIELD OF THE INVENTION

This invention relates to a device for the separation of gas which may be entrained in a flow of liquid. Preferably, the device also controls the amount of gas that is expelled in the liquid that is dispensed from the device.

BACKGROUND OF THE INVENTION

In many applications it is important to measure accurately the volume of liquid passing through a pipe or tube, for example a fuel dispenser, such as a petrol pump. If the liquid is contaminated with gas, such as air, vapour and/or other gas, the meter, which cannot differentiate between the liquid and the gas, will produce an erroneous reading for the volume of liquid dispensed. Thus the purchaser of the fuel will pay not only for the fuel actually dispensed, but also for any gas entrained in the fuel flow line.

It is known, for example from Australian Patent No. 460441, to provide a device in the fuel flow line to separate the gas from the liquid by arranging for the liquid to flow through a separation tank, located upstream of the meter, in which any gas can rise to the top and from which liquid is drawn from the bottom. Exit of liquid out of the tank is via a main valve which is controlled either by a pilot valve or by an orifice to close the main valve when there is a substantial volume of gas in the tank. This gas escapes from the tank via a vent passage to an air separation sump, the tank replacing the escaping gas with further liquid or liquid/gas mixture. When the pilot valve or orifice sense that the liquid/gas mixture in the tank has again reached a certain level, the main valve is opened to allow liquid to flow at normal operating levels.

Although the above-described device works reasonably well, it needs to be built into the liquid dispensing system with the various valves and the orifice being interconnected by pipes or hoses which requires a substantial investment and a relatively large amount of space.

SUMMARY OF THE INVENTION

It is therefore an object of the present invention to provide a device for separating gas from liquid, which is more compact, has a small number of components, is cheap to manufacture and which will automatically adapt to the requirements of liquids of different viscosities, densities and/or flowrates.

Accordingly, the invention provides a device for separating gas entrained in a flow of liquid, the device comprising a main housing having a liquid inlet and a liquid outlet, a separation volume within the housing between the inlet and the outlet, a vent passage extending from the separation volume to the outside of the housing, a main valve within the housing for controlling flow of liquid between the inlet and the outlet, means for detecting the presence of gas in the vent passage, a pilot valve coupled to the detecting means and the main valve for controlling the main valve in dependence on the presence of gas in the vent passage.

In a preferred embodiment, the detecting means is a dual orifice arrangement in the vent passage and the pilot valve is coupled to the dual orifice arrangement via a first control passage within the housing. The dual orifice arrangement is preferably removable from the vent passage.

In a preferred embodiment of the invention, the pilot valve is a poppet valve operated by a diaphragm which is caused to close when gas is detected in the vent passage. The pilot valve is preferably arranged to close a second control passage extending between the main valve, which is preferably a diaphragm valve, and an inlet downstream of the main valve. The second control passage is preferably coupled to the main valve on the downstream side such that, when the second control passage is open, pressure on the downstream side of the diaphragm is smaller than on the upstream side, thereby causing the diaphragm to be opened against the action of a biasing means, such as a spring. When, however, the second control passage is closed by the pilot valve, the pressure on the downstream and upstream sides of the diaphragm is equalised by means of a bleed connection between the two sides of the diaphragm. The bleed connection is preferably a bleed orifice in the diaphragm, but could, alternatively, be a bleed passage within the housing.

BRIEF DESCRIPTION OF THE DRAWING

The invention will now be more fully described, by way of example, with reference to the drawings, of which.

DETAILED DESCRIPTION OF THE PREFERRED EMBODIMENTS

Figure 1:
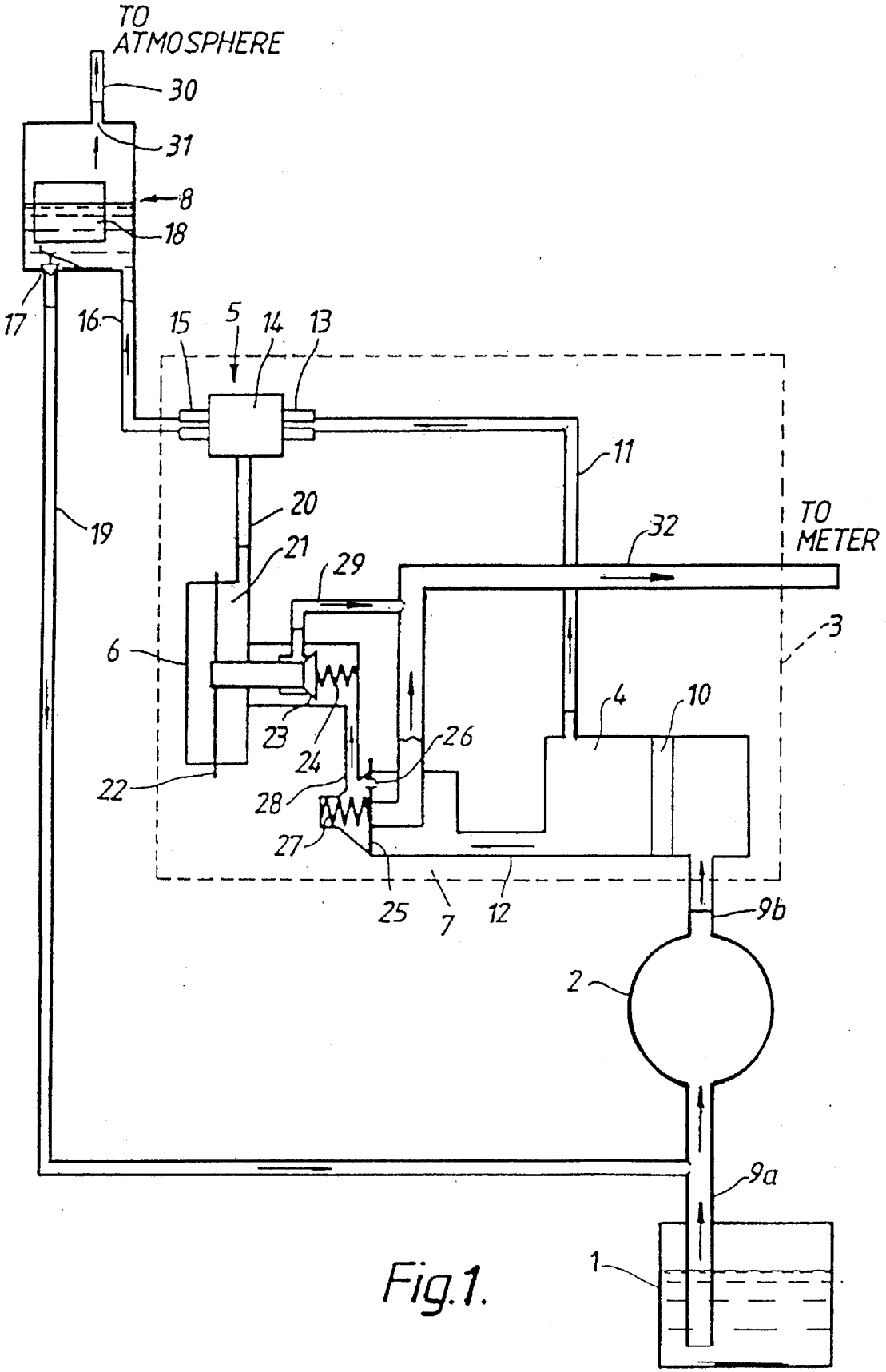
FIG. 1 is a schematic diagram of a gas detection system incorporating a gas separation device according to one embodiment of the present invention.
Figure 2:
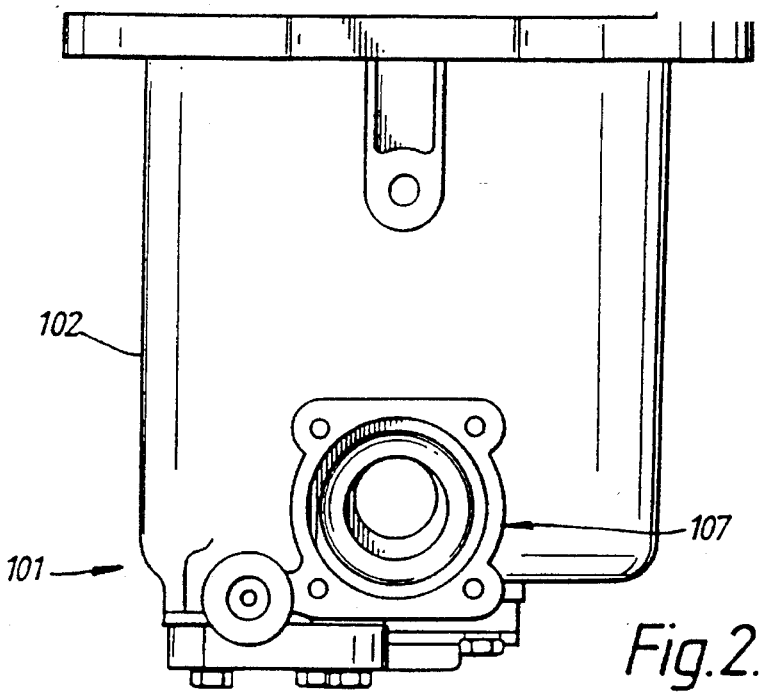
FIG. 2 is a top view of one embodiment of gas separation apparatus according to the invention.
Figure 3:
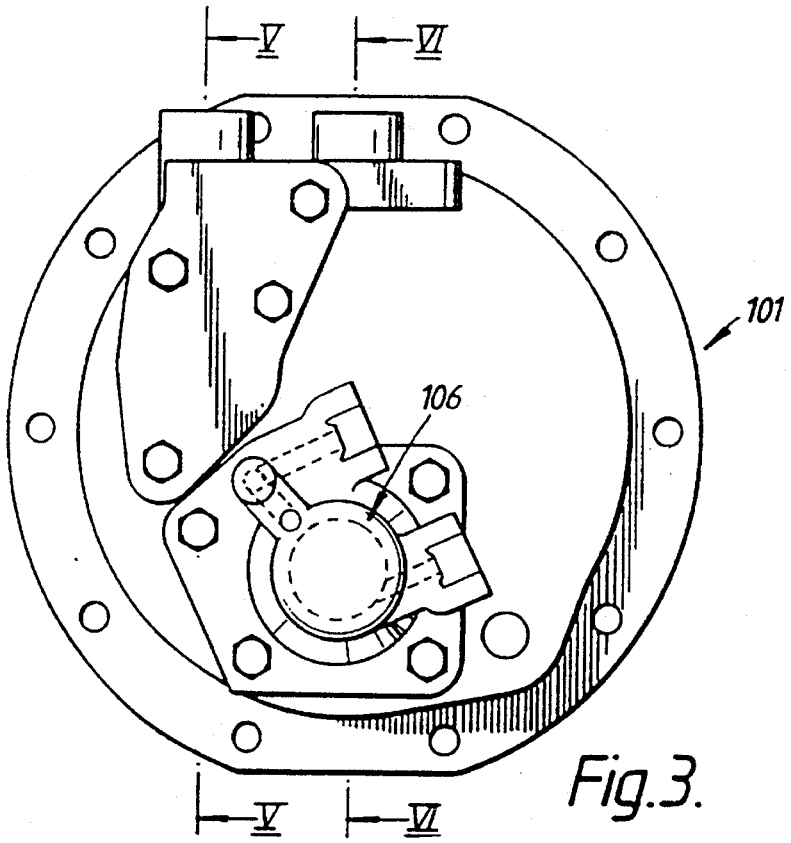
FIG. 3 is a view of one end of the apparatus of FIG. 2.
Figure 4:
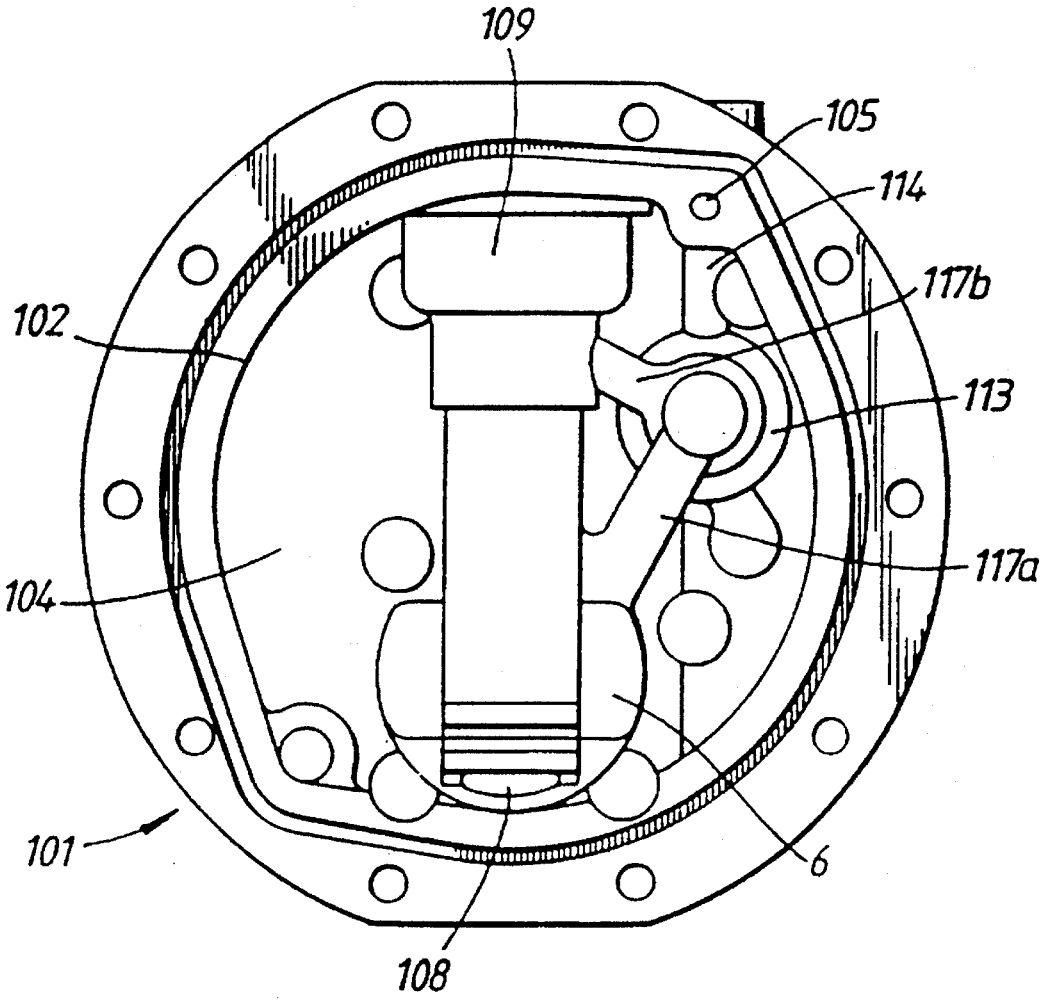
FIG. 4 is a view of the other end of the apparatus of FIG. 2.
Figure 5:
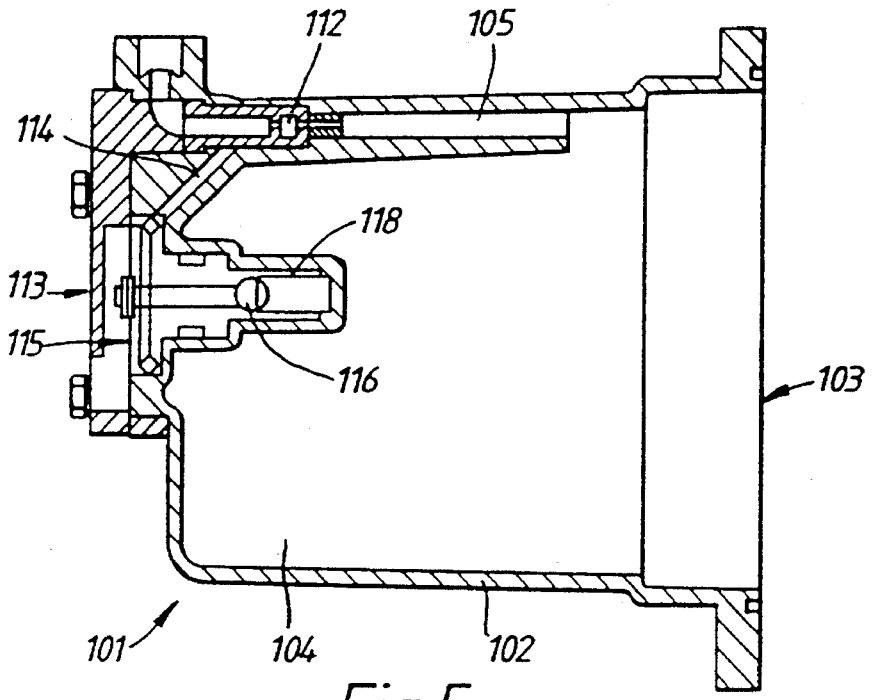
FIG. 5 is a cross-sectional view on line V—V in FIG. 3.

As shown in FIG. 1, the system comprises a pump 2 having coupled thereto an integrated gas separation device 3, which consists of a gas separator 4, a gas detector 5 formed by a dual orifice, a pilot valve 6 operated by the gas detector 5 and a main flow valve 7 controlled by the pilot valve 6. Also coupled to the pump 2 is an air separator sump unit 8, used to expel any gas present and return liquid to the pump inlet.

The pump 2, which is a suction pump, draws fuel, which may have gas entrained therein, from a tank 1 through pipe **9*a* and supplies the fuel to the gas separation device 3 through passage 9*b***.

The fuel first enters a passive separator 4 where the fuel velocity is reduced through a baffle 10. This allows time for any entrapped gases to rise and escape with fuel through passage 11 to the dual orifice gas detector 5. The main flow of substantially gas free liquid exits through passage 12 to the main flow valve 7.

The gas detector 5 has an inlet orifice 13 and an outlet orifice 15 separated by a chamber 14. When substantially gas free fuel from the separator 4 passes through the inlet orifice 13 and across chamber 14 in a stream to enter the outlet orifice 15, a low pressure (partial vacuum) is created in chamber 14. The fuel flows through passage 16 from the outlet orifice 15 to the air separator sump unit 8.

In the air separator sump unit 8 any gases are expelled and the liquid fuel is returned to the pump inlet by tube 19. The flow of returning fuel is controlled by valve 17 which is operated by float 18.

Chamber 14 is connected by passage 20 to a chamber 21 containing a diaphragm 22 of the pilot valve 6. The low pressure acts on the diaphragm 22 in the chamber 21 and opens a popper valve 23 against the action of pump pressure and spring 24. The opening of poppet valve 23 allows fuel to flow from passage 28 to passage 29.

Fuel flow through passage 28 and 29 is controlled by an orifice 26 formed in diaphragm 25 in main flow valve 7. This flow creates a pressure drop across diaphragm 25 in main flow valve 7. When the pressure drop across the diaphragm 25 is great enough to overcome the bias of a spring 27 the main flow valve 7 opens. Fuel can now flow from the separator 4 via passage 12 to passage 32 to a fuel meter, and then to a hose and nozzle where it is dispensed.

Any gas in the fuel is concentrated in the fuel gas mixture exiting the separator 4 through passage 11 to the dual orifice gas detector 5. The presence of gas in the liquid entering the detector 5 causes a sudden increase in pressure in chamber 14 between the orifices 13 and 15, the pressure changes from a partial vacuum to a positive pressure. This is caused by the expansion of the gas after orifice 13, due to the pressure difference across the inlet orifice 13 breaking up the liquid stream so that it does not cleanly enter the second orifice 15.

The pressure increase is transmitted along passage 20 to chamber 21, this reduces the pressure on the pilot valve diaphragm 22. This allows the spring 24 to close the pilot valve, stopping the flow of fuel along passages 28, and 29 and through orifice 26. The stopping of flow through the orifice 26 in diaphragm 25 allows the pressures to equalise on each side of diaphragm 25. The spring 27 now pushes the flow valve 7 closed. No fuel is dispensed while there is gas being expelled from the separator 4 via passage 11. This ensures that the amount of gas metered and dispensed is not in excess of the required limits.

As shown in FIGS. 2 to 6 of the drawings, a first embodiment of an apparatus comprises a main housing 101 comprising a generally hollow cylinder 102 arranged to be mounted in a fuel dispensing pump upstream of the fuel meter. The fuel, which may have gas, such as air or vapour entrained therein enters the housing through inlet 103 into a separation volume 104 where the flow is reduced so that any gas can rise to the top of volume 104 and escape through vent passage 105. The main flow of liquid passes through a main valve 106 to outlet 107, which is connected to the meter (not shown) and a fuel nozzle (not shown).

Figure 6:
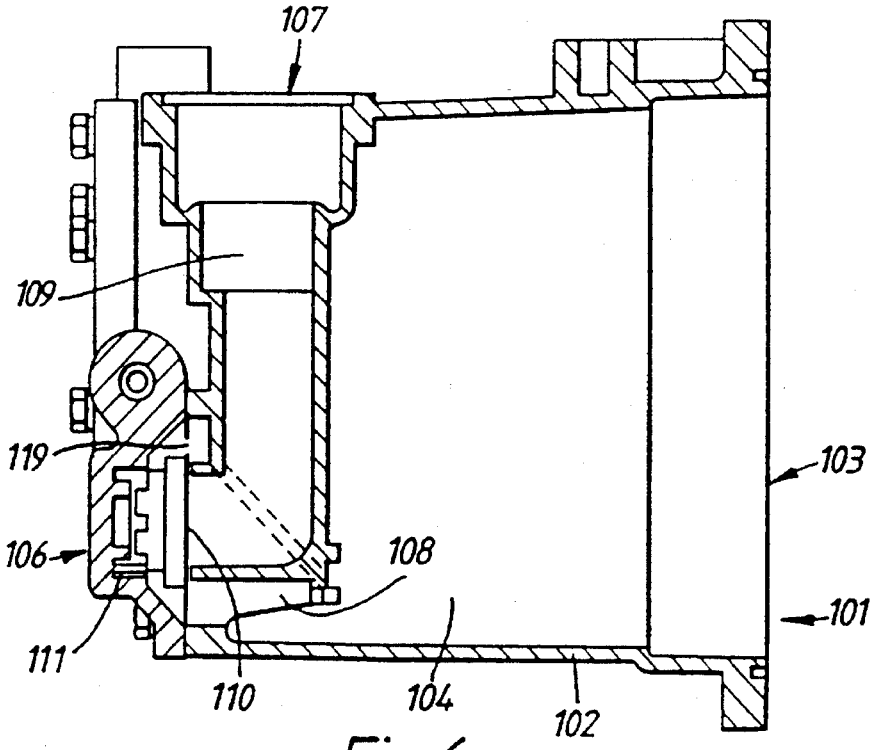
FIG. 6 is a cross-sectional view on line VI—VI in FIG. 3.

The liquid flows from separation volume 104 via a main valve inlet 108 into a main outlet passage 109. The main valve 106 comprises a diaphragm 110 biased by spring 111 to close the main outlet passage 109. A bleed aperture 119 is provided between the upstream and downstream sides in diaphragm 110 so as to equalise the pressure. When this happens, the force of spring 111 biases the diaphragm 110 to the closed position, as shown in FIG. 6.

Within vent passage 105, there is provided a gas detector 112. The gas detector 112 comprises an inlet orifice and an outlet orifice separated by a chamber. As long as only liquid flows through vent passage 105, and therefore through gas detector 112, a low pressure (partial vacuum) is created in the chamber due to the liquid stream passing straight into the outlet orifice. The low pressure is coupled to a pilot valve 113 via first control passage 114. The pilot valve 113, which includes a diaphragm 115 connected to a ball valve 116, is arranged to open and close a second control passage 117 extending from the main valve 106 on the downstream side of diaphragm 110 to the main outlet passage 109. The second control passage 117 therefore comprises a first portion **117*a* extending from the main valve 106 to an inlet of pilot valve 113, and a second portion 117*b* extending from an outlet of pilot valve 113 to main outlet passage 109. The ball valve 116, controlled by diaphragm 115, and biasing means, such as a spring 118, opens and closes the pilot valve 113. The first control passage 114 is arranged to open pilot valve 113, by coupling reduced pressure on one side of the diaphragm 115, when the partial vacuum extends through first control passage 114 due to liquid passing through vent passage 105 and detector 112**.

When pilot valve 113 is open, liquid is allowed to flow through second control passage 117 and therefore reduces the pressure on the downstream side of diaphragm 110 of main valve 106. Therefore, pressure on the upstream side of main valve 106 forces diaphragm 110 to open against the bias spring 111.

When, however, gas separates from the liquid fuel in separation volume 104, the gas rises to the top of the volume and escapes through vent passage 105. The presence of gas causes a sudden increase in pressure in the chamber between the two orifices due to the pressure difference across the inlet orifice causing expansion of the gas. The expanding gas breaks up the liquid steam so that it does not enter the outlet orifice cleanly. Therefore the pressure on either side of diaphragm 115 of pilot valve 113 is equalised, thus closing pilot valve 113. When pilot valve 113 is closed, as described earlier, pressure on either side of diaphragm 110 of main valve 106 is equalised through bleed aperture 119 so that diaphragm 110 is biased closed by spring 111, thus closing the main valve 106.

The main valve 106 thus remains closed until all the gas separated from the liquid in separation volume 104 has escaped through vent passages 105 and liquid once again flows through detector 112 causing reduced pressure in first control passage 114 so as to open pilot valve 113 and thus main valve 106.

It will be apparent that in certain circumstances it will not be required to turn off the main valve when gas completely separates from liquid in volume 104 and therefore detector 112 is made easily removable, whereupon first control passage 114 can be capped off.

Figure 7:
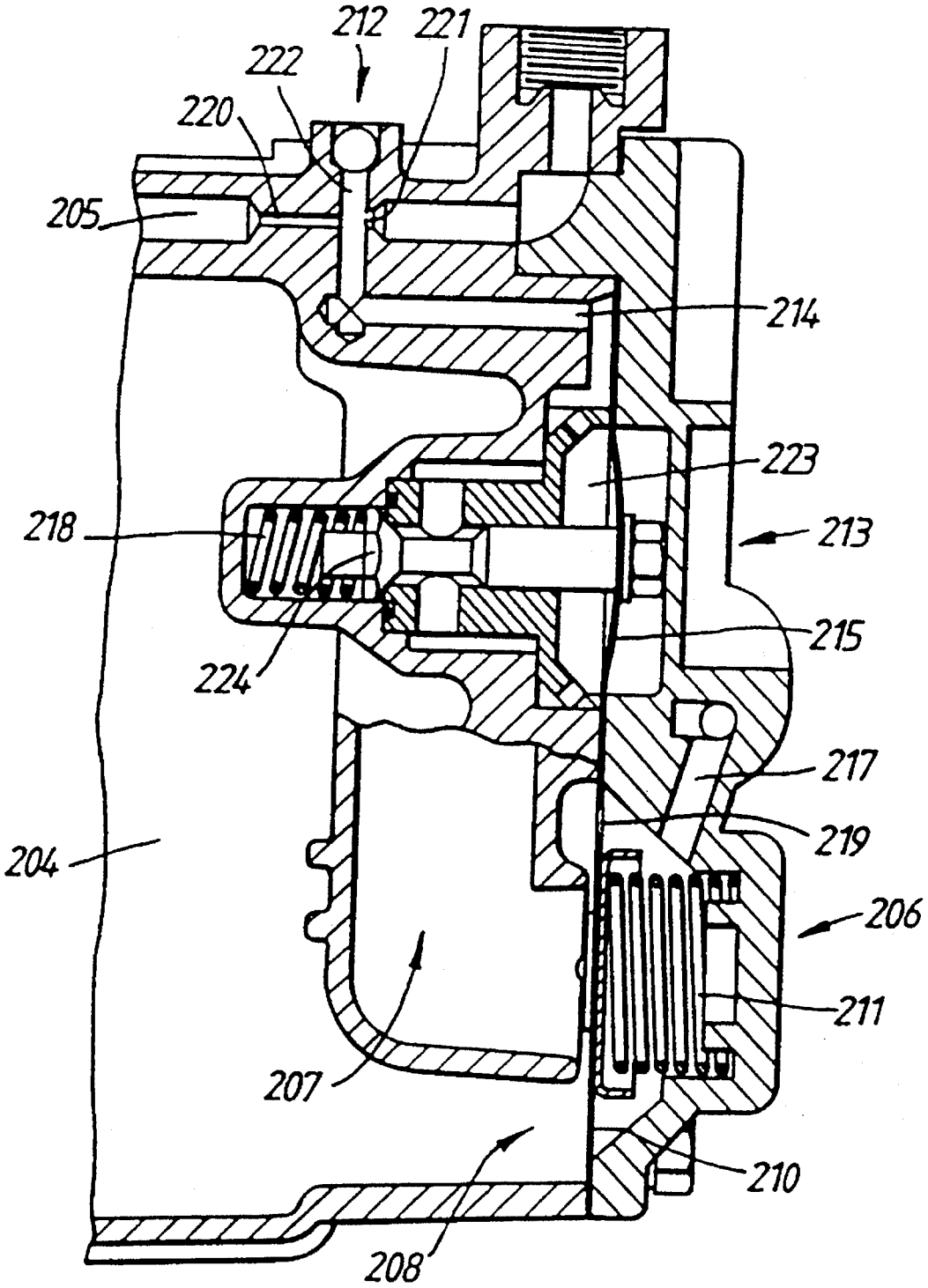
FIG. 7 is an enlarged part cross-sectional view of a portion of a second embodiment of an apparatus according to the invention.

FIG. 7 shows part of a second embodiment of a gas separation device according to the invention. There is shown a portion of a separation volume 204 and a vent passage 205 leading to a gas detector 212 having an inlet orifice 220 and an outlet orifice 221 separated by a chamber 222. The chamber 222 is coupled via a control passage 214 to a chamber 223 in which is arranged a diaphragm 215 of a pilot valve 213. The diaphragm 215 is coupled to a poppet valve 224 biased to a closed position by spring 218. When a reduced pressure is coupled from chamber 222 via passage 214 to chamber 223, the pressure difference between the two sides of diaphragm 213 causes the poppet valve 224 to be opened against the bias of spring 218.

Poppet valve 224 closes a control passage 217 coupled to a downstream side of a diaphragm 210 of a main valve 206. When the poppet valve 224 is closed, pressure on either side of diaphragm 210 is equalised via an aperture 219 in the diaphragm 210, causing the main valve to be biased closed by a spring 211. However, when the poppet valve 224 is open, the flow of liquid through control passage 217 reduces the pressure on the downstream side of diaphragm 210, causing the pressure on the upstream side to open the diaphragm against the bias of spring 211 and therefore open the main valve 206 to flow of fuel through main valve inlet 208 to main fuel outlet 207. It will be appreciated that other features of the second embodiment of the gas separation apparatus are similar to those described earlier.

It will be clear, therefore that the present invention provides a much more compact modular construction of a device for separating gas from liquids than was previously the case.

We claim:

1. A device for separating gas entrained in a flow of liquid, the device comprising a main housing having a liquid inlet and a liquid outlet; a separation chamber disposed within the housing between the inlet and the outlet, the gas entrained in the flow of liquid being separated from the flow of liquid when the flow of liquid passes from the inlet to the outlet within the separation chamber; a vent passage extending from the separation chamber; a main valve within the housing for controlling the flow of liquid between the inlet and the outlet; means for detecting a presence of a gas in the vent passage comprising a dual orifice arrangement disposed in the vent passage; a pilot valve coupled to the means for detecting and to the main valve for controlling the main valve as a function of the presence of gas in the vent passage; and a first control passage within the housing for coupling the pilot valve to the dual orifice arrangement.

2. A device according to claim 1, wherein the dual orifice arrangement comprises an inlet orifice and an outlet orifice separated by a dual orifice chamber coupled to the first control passage.

3. A device according to claim 2, wherein the pilot valve comprises a pilot valve chamber including a diaphragm operated poppet valve having a diaphragm and a biasing means for biasing the diaphragm, the first control passage being coupled to the pilot valve chamber such that, when gas does not flow through the dual orifice arrangement, a reduced pressure is produced in the pilot valve chamber, the reduced pressure being coupled to one side of the diaphragm so that the difference in pressure between both sides of the diaphragm causes the diaphragm to move and open the pilot valve against a bias of the biasing means, and when gas does flow through the dual orifice arrangement, pressure in the chamber is not reduced and the pilot valve is closed by the bias of the biasing means.

4. A device according to claim 1, wherein the dual orifice arrangement is removable from the vent passage.

5. A device according to claim 1, wherein the pilot valve is a diaphragm operated valve which is caused to close when gas is detected in the vent passage.

6. A device according to claim 1, wherein the main valve is a diaphragm operated valve.

7. A device according to claim 1, and further including a second control passage extending between the main valve and an outlet upstream of the main valve wherein the pilot valve is effective for closing the second control passage.

8. A device according to claim 7, wherein the main valve comprises a diaphragm operated valve including a diaphragm, a biasing means for biasing the diaphragm, and a bleed connection between the two sides of the diaphragm, the diaphragm having an upstream side and a downstream side, and wherein the second control passage is coupled to the main valve on the downstream side of the diaphragm such that, when the second control passage is open, pressure on the downstream side of the diaphragm is smaller than pressure on the upstream side of the diaphragm, thereby causing the diaphragm to be opened against a bias of the biasing means, and when the second control passage is closed by the pilot valve, pressures on the downstream side and on the upstream side of the diaphragm are equalised by the bleed connection.

9. A device according to claim 8, wherein the bleed connection is a bleed orifice in the diaphragm.

10. A device according to claim 8, wherein the bleed connection is a bleed passage within the housing.

* * * * *